United States Patent [19]

Roberts

[11] Patent Number: 4,484,422

[45] Date of Patent: Nov. 27, 1984

[54] SLAB-HANGING MEANS AUXILIARY SUPPORT MEANS

[75] Inventor: Lewis L. Roberts, Indianapolis, Ind.

[73] Assignee: Mercury Development Corporation, Indianapolis, Ind.

[21] Appl. No.: 421,891

[22] Filed: Sep. 23, 1982

[51] Int. Cl.[3] ..... E04H 13/00

[52] U.S. Cl. ..... 52/137; 52/509

[58] Field of Search ..... 52/137, 378, 128, 509, 52/139, 136, 234, 704, 707, 698, 702

[56] References Cited

U.S. PATENT DOCUMENTS

| | | | |
|---|---|---|---|
| 2,574,938 | 11/1951 | Sinner et al. | 52/509 X |
| 2,618,145 | 11/1952 | Sinner et al. | 52/509 |
| 2,814,942 | 12/1957 | Sinner et al. | 52/509 |
| 2,853,870 | 9/1958 | Sinner et al. | 52/509 X |
| 2,860,504 | 11/1958 | Sinner et al. | 52/509 X |
| 3,213,576 | 10/1965 | Davies | 52/139 X |
| 3,342,005 | 9/1967 | Rickards et al. | 52/509 X |
| 3,778,942 | 12/1973 | Bondi | 52/509 X |
| 3,990,199 | 11/1976 | Gallo | 52/137 |

*Primary Examiner*—J. Karl Bell

*Attorney, Agent, or Firm*—Robert A. Spray

[57] ABSTRACT

A slab-hanging device which removably supports the slabs of crypts in the desired flush array of a whole series of such slabs, as provide the front and removable wall of mausoleum crypts, which has an auxiliary support member adjustably supporting the device in a desired position in front of the crypts' supporting structure and in a desired particular position in front of that structure and accommodating the irregularities of that surface, preventing sagging of the slab-support caused by heaviness of the slabs.

6 Claims, 2 Drawing Figures

SLAB-HANGING MEANS AUXILIARY SUPPORT MEANS

Figure 1:
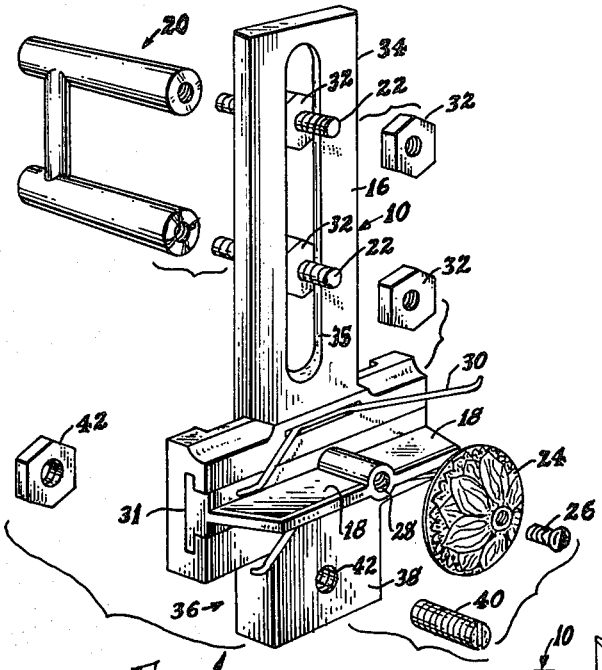

The present invention relates to slab-hanging devices, such as are used for removably supporting the heavy marble face-walls of mausoleum crypts, in an arrangement in which a whole array of such face-walls are positioned in an attractive flush manner even though the supporting surfaces of the crypt structure are somewhat irregular and/or uneven.

More particularly, the slab-hanging devices of such type of installation provide fastener means which are embedded in the associated supporting structure of the crypt, and which extend outwardly to provide the desired position of the supporting devices so that the whole array of slabs are flush and even.

The present invention, more particularly, provides an auxiliary support means, which is adjustable so as to supportingly contact the crypt's supporting structure to brace the fasteners against sagging or deflection of the fasteners due to the heavy weight of the slabs.

The prior art for years is represented by the following U.S. Patents:

J. B. Sinner, J. W. Rickards, et al, U.S. Pat. No. 3,342,005, Sept. 19, 1967,

J. B. Sinner, et al, U.S. Pat. No. 2,853,870, Sept. 30, 1958,

J. B. Sinner, et al, U.S. Pat. No. 2,618,145, Nov. 18, 1952,

J. B Sinner, et al, U.S. Pat. No. 2,574,938, Nov. 13, 1951,

J. B. Sinner, et al, U.S. Pat. No. 2,363,156, Nov. 21, 1944,

J. B. Sinner, U.S. Pat. No. 2,080,190, May 11, 1937.

Additional prior art has been found to be devices of Aeon Mfg. Co., 929 W. 253rd Street/P.O. Box 351, Harbor City, Calif. 90710.

The present invention provides an advantageous improvement over particularly slab-hanging devices such as those marketed as Models 801 and 802 of the Aeon Company, and various models marketed by Sinner Brothers, Inc., 3459 Hancock Street, San Diego, Calif. 92110, which are commercial structures utilizing one or more concepts of those prior art patents.

These slab-hanging devices have a vertical hanger portion for attachment to the associated supporting structure, and they have a ledge means which seats portions of a pair of the slabs. They are provided with fastener means held by the associated supporting structure of the crypt, and are engageable with the vertical hanger portion for securing the slab-hanging means to the associated supporting structure in a selected position outwardly of the associated supporting crypt structure for the accommodation of irregularities of that structure but nevertheless keep a desired flushness of the array of slabs.

In carrying out the invention, there is provided an auxiliary support means which is substantially spaced from the portion of the vertical hanger portion engaged by the fastener means; and more particularly, the auxiliary support means is adjustable in nature so as to be supportingly engageable with the crypt's associated supporting structure regardless of how far the fastener means outwardly extend to provide the selected position of support of the vertical hanger portion needed for achieving the desired slab-flushness.

By the auxiliary support means there is thus provided a brace type support acting through the slab-hanging device to support the outwardly-extending portions of the fastener means against sagging due to the heavy weight of the slabs upon the device's support ledge.

Figure 2:
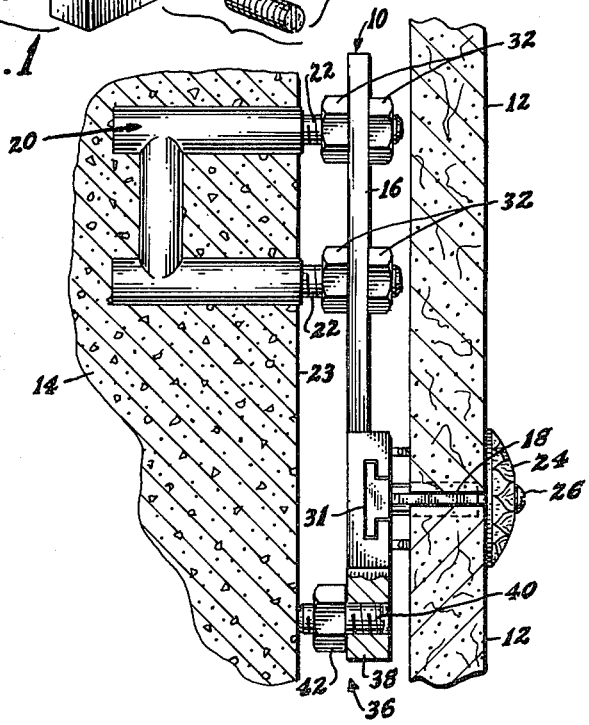

The above description is of somewhat introductory and generalized form. More particular details, concepts, and features are set forth in the following and more detailed description of an illustrative embodiment, taken in conjunction with the accompanying drawings, which are of somewhat schematic and diagrammatic nature, and in which:

FIG. 1 is an exploded pictorial view illustrating a slab-hanging device of the prior art, but provided with an auxiliary support brace means of the present invention; and FIG. 2 is a vertical view through the front of a mausoleum crypt installation equipped with the slab-hanging device of FIG. 1, and in a desired position of adjustment for bracing the outwardly-extending fasteners of the device.

As shown in the drawings, the present invention provides a significant improvement over a type of slab-hanging means 10 of the prior art, the slab-hanging means 10 being a device for removably supporting a vertically-arranged series of slabs 12 upon associated supporting structure here shown as the front-face concrete wall 14 of a mausoleum crypt.

Such a slab-hanging means of the prior art is of a type which has a vertical hanger portion 16 for attachment of the device to the associated supporting structure 14; and it has, at a relatively low portion of the vertical hanger portion 16, an outwardly-extending ledge means 18 for seating thereon of the contiguous portions of a pair of the slabs 12.

For such device, the prior art provides fastener means 20 which are held by being embedded in the associated supporting structure 14 and extending portions 22 supportingly engageable with the vertical hanger portion 16 of the device 10, thus securing the slab-hanging device 10 to the associated supporting structure 14, in whatever is the selected position outwardly of the associated supporting structure 14, this being for the accommodation of the inevitable irregularities of the concrete crypt wall-faces 23 yet keep a desired attractive flushness of the series of slabs 12.

Also the prior art provides retainer means shown as a designed head 24 held by screw 26 in ledge-opening 28 for retaining the slabs 12 in their supported position on the ledge member 18.

The prior art has other features, such as a pressure spring 30 for applying a tight pressure on the slabs 12, an adjustable slide feature 31 of the ledge 18, and pairs of nuts 32 on the threaded outer portions 22 of the fasteners 20 for providing the selected outward position of the upper portion 34 of the vertical hanger portion 16 of the device 10, those fastener portions 22 shown as extending through a vertical slot 35 in the vertical hanger portion 16.

It is with such a prior art slab-hanging device 10 that the concepts of the present invention are here shown, and which device 10 is substantially improved.

According to the present invention's concepts, slab-hanging means 10 of such prior art is advantageously provided with an auxiliary support means 36 which is shown substantially spaced from the portion 34 of the vertical hanger portion 16 which is engaged by the fastener means 20.

More particularly as shown, the auxiliary support means 36 is provided to be of adjustable nature, so as to be supportingly engageable with the front face-walls 23 of the associated supporting structure 14 regardless of whatever is the outward nature of the selected position of support of the vertical hanger portion 16 of the hanger device 10.

As shown in FIG. 2, the auxiliary support means 36 thus serves to provide support, which acts through the slab-hanging means 10 and its portion 16 to bracingly support the outwardly-extending portions 22 of the fastener means 20 against sagging due to the heavy weight of the slabs 12 upon the ledge member 18.

In the form shown, advantageously and economically the auxiliary support means 36 has a support member 38 which is provided as an integral extension of the slab-hanging means 10.

Further, as shown the auxiliary support means 36 includes a bolt means 40 which is screw-threadedly engageable with a threaded opening 42 provided in the extension member 38 of the slab-hanging device 10. The screw-type adjustment of the bolt means 40 with respect to the slab-hanging means 10 provides accommodation of various positions of support of the device as desired to achieve the desired slab-flushness.

In the form shown, the auxiliary support means 36 further comprises a nut means 42' which is screw-threadedly engageable with the bolt means 40; and the adjustment of the nut means 42' with respect to the bolt means 40 provides further adjustment of the auxiliary support means 36 for its accommodation of various positions of support of the slab-hanging device 10. The brace-type support means 36 thus serves a bracing function by sustaining the force of the weight of the slabs 12 acting downwardly through the hanger device 10, and acts upwardly through the device to brace the fastener means 20, particularly its outwardly-extending bolt-portions 22.

It is thus seen that a slab-hanging device according to the inventive concepts as herein set forth provides a desired and advantageous device, yielding the advantages of sturdy support of outwardly-extending fasteners even though extending outwardly to accommodate surface irregularities yet achieve desired flushness and alignment of installation of an array of slab-facings such as in a whole array of crypts of a mausoleum, and preventing sagging of the fasteners even though they extend outwardly for such accommodation and even though the slabs are quite heavy.

Accordingly, it will thus be seen from the foregoing description of the invention according to this illustrative embodiment, considered with the accompanying drawings, that the present invention provides new and useful combination concepts of a novel and advantageous slab-mounting device, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. Slab-hanging means for removably supporting a vertically-arranged series of slabs upon associated supporting structure, the slab-hanging means having a vertical hanger portion for attachment to the associated supporting structure and having outwardly extending from a relatively low portion of the vertical hanger portion a ledge means upon which seat the contiguous portions of a pair of the slabs, there being provided fastener means held by the associated supporting structure and having outwardly-extending portions supportingly engageable with the vertical hanger portion for securing the slab-hanging means to the associated supporting structure in selected position outwardly of the associated supporting structure for accommodation of irregularities thereof yet keep a desired flushness of the series of slabs, and means for retaining the slabs in supported position on the ledge means, the improvement, for such slab-hanging means, of an auxiliary support means substantially spaced from the portion of the vertical hanger portion engaged by the fastener means, the auxiliary support means being between the supporting structure and the slab-hanging means, and being of adjustable nature so as to be supportingly engageable with the associated supporting structure regardless of whatever is the outward nature of the selected position of support of the vertical hanger portion, the auxiliary support means being connected to the slab-hanging means and providing a horizontal thrust engagement against the associated supporting structure, the said auxiliary support means thus serving to provide a bracing support by said horizontal thrust engagement, acting upwardly through the slab-hanging means, to support the outwardly-extending portions of the fastener means against sagging or deflection of the fastener means due to the weight of the slabs upon the ledge means, by sustaining the force of the weight of the slabs.

2. The invention as set forth in claim 1 in a combination in which the auxiliary support means has a support member which is provided as an integral extension of the slab-hanging means.

3. The invention as set forth in either of claims 1 or 2 in a combination in which the auxiliary support means comprises a bolt means screw-threadedly engageable with a portion of the slab-hanging means, the adjustment of the bolt means with respect to the slab-hanging means providing accommodation of various positions of support thereof.

4. The invention as set forth in claim 2 in a combination in which the auxiliary support means comprises a bolt means screw-threadedly engageable with the integrally-extending support member of the slab-hanging means, the adjustment of the bolt means with respect to the said support member of the slab-hanging means providing accommodation of various positions of support thereof.

5. The invention as set forth in claim 3 in a combination in which the auxiliary support means further comprises a nut means screw-threadedly engageable with the bolt means, the adjustment of the nut means with respect to the bolt means providing further adjustment of the auxiliary support means for accommodating various positions of support of the slab-hanging means.

6. The invention as set forth in claim 4 in a combination in which the auxiliary support means further comprises a nut means screw-threadedly engageable with the bolt means, the adjustment of the nut means with respect to the bolt means providing further adjustment of the auxiliary support means for accommodating various positions of support of the slab-hanging means.

* * * * *

UNITED STATES PATENT AND TRADEMARK OFFICE

CERTIFICATE OF CORRECTION

PATENT NO. : 4,484,422

DATED : November 27, 1984

INVENTOR(S) : Lewis L. Roberts

It is certified that error appears in the above—identified patent and that said Letters Patent is hereby corrected as shown below:

Both Fig. 1 and Fig. 2 of the drawings, plus the extra drawing made from Fig. 1 for the patent's cover sheet, should be marked to show the addition of a prime mark (') to the numeral 42 as appears on the nut which is now marked with reference numeral 42. (This instruction does not apply to the threaded hole which also bears reference numeral 42.)

Signed and Sealed this

*Third* Day of *September 1985*

[SEAL]

*Attest:*

DONALD J. QUIGG

*Attesting Officer* *Acting Commissioner of Patents and Trademarks - Designate*